US006725941B2

(12) United States Patent
Edwards et al.

(10) Patent No.: US 6,725,941 B2
(45) Date of Patent: Apr. 27, 2004

(54) FIRE RETARDANT DELIVERY SYSTEM

(76) Inventors: Paul Edwards, 3208 Stephanie Ct., San Jose, CA (US) 95132; Gregory Ruebusch, 13321 Franklin Ave., Mountain View, CA (US) 94040

( * ) Notice: Subject to any disclaimer, the term of this patent is extended or adjusted under 35 U.S.C. 154(b) by 0 days.

(21) Appl. No.: 09/860,622

(22) Filed: May 18, 2001

(65) Prior Publication Data

US 2002/0017388 A1 Feb. 14, 2002

Related U.S. Application Data

(60) Provisional application No. 60/205,656, filed on May 18, 2000.

(51) Int. Cl.[7] ..... A62C 2/00; A62C 3/00

(52) U.S. Cl. ..... 169/47; 169/30; 169/36; 169/43; 169/46; 169/56; 169/57; 169/58

(58) Field of Search ..... 169/30, 36, 43, 169/46, 47, 48, 49, 50, 56, 57, 58, 89

(56) References Cited

U.S. PATENT DOCUMENTS

| | | | | |
|---|---|---|---|---|
| 297,075 A | | 4/1884 | Harden | |
| 2,003,300 A | | 6/1935 | Meigs | |
| 4,100,970 A | | 7/1978 | Kreske, Jr. | 169/26 |
| 4,836,292 A | * | 6/1989 | Behringer | 169/47 |
| 5,461,874 A | * | 10/1995 | Thompson | 169/36 |
| 5,507,350 A | | 4/1996 | Primlani | 169/36 |
| 5,919,393 A | | 7/1999 | Flynn et al. | 252/2 |

FOREIGN PATENT DOCUMENTS

| | | | | |
|---|---|---|---|---|
| RU | 2147901 C1 | * | 4/2000 | A62C/3/02 |

* cited by examiner

*Primary Examiner*—Robin O. Evans
(74) *Attorney, Agent, or Firm*—Fish & Richardson P.C.

(57) ABSTRACT

A fire extinguishing and fire retarding method is provided comprising the step of confining a fire extinguishing and fire retarding agent in slurry, liquid or gaseous form within a shell wherein the shell comprises such an agent in solid form. An agent such as ice water, or liquid carbon dioxide is useful when employing the shell as "non-lethal" device. The solid shell is sublimable and will burst upon impact or upon exposure to the environmental conditions at the target site to release the contents of the shell as well as the fragments of the shell onto the target site.

24 Claims, 2 Drawing Sheets

FIRE RETARDANT DELIVERY SYSTEM

This application claims benefit of Provisional Ser. No. 60/205,656, filed May 18, 2000.

The present invention is an embodiment of the designed phase-change canister material delivery system as applied to a fire extinguishing method and system in which the delivery capsule is formed by confining a fire extinguishing agent within a designed phase change container comprising the shell of a fire extinguishing agent in solid form. The container is delivered and allows delivery, in close proximity to burning substances such that release of the agent from the ruptured container and the container itself extinguishes or suppresses the fire.

BACKGROUND OF THE INVENTION

The present invention provides a fire extinguishing and fire retardant delivery method and system to suppress and extinguish fires, in particular, wildfires. Wildfires, which include forest and range fires, are fully self-sustaining and are either of such a size or in such a location, which make them unmanageable by conventional means. Current technologies for wildfire suppression are fuel starvation and/or removal and aerial delivery of suppression agents, such as water and retardant slurries. The self-sustaining nature of wildfires means that they generate very large incoming airflows, vertical updrafts and turbulence, which provide fuel/air sourcing and mixing. These airflow patterns generated by these fires make it difficult to deliver slurry retardant and/or water to the core of the fire. Delivery of such materials to the core of the fire can cool, block infrared transmission, and deprive the fire of fuel. The system of the present invention provides a method and means for delivering to a fire target, a retardant or extinguishing material in a thermal and/or pressure-sensitive container.

Another direct application of the type of container embodied in this patent is the use as a non-lethal weapon. The rupture of the canister can have a stun effect coupled with the disbursement of material into a crowd.

SUMMARY OF THE INVENTION

A fire suppression or extinguishing method is provided comprising the step of confining a fire extinguishing or suppressing agent in slurry, liquid or gaseous form within a phase-change canister which comprises a shell of such an agent in solid form. The optimum system uses an agent in solid form which sublimates at atmospheric pressure at temperatures above about −150° C. The container is designed and delivered in close proximity to burning substances such that the container ruptures releasing the agent onto the burning substance.

The container is formed such that the shell comprises an agent in solid form and the inner core is filled with an agent in slurry, liquid or gaseous form.

The container may be made on an apparatus comprising a shaped molding cavity for receiving the liquid agent to form a shell; a feature for cooling the surface to solidify the liquid to form the shell, a feature for filling the shell with the liquid agent and sealing the shell to form the container, and a feature for releasing the container from the molding surface. Another apparatus for forming the container comprises a shaped molding cavity for receiving the liquid agent to form a shell; a feature to solidify the liquid to form the shell by a pressure-controlled phase change and a feature for releasing the container from the molding surface

DESCRIPTION OF THE PREFERRED EMBODIMENTS

Figure 1:
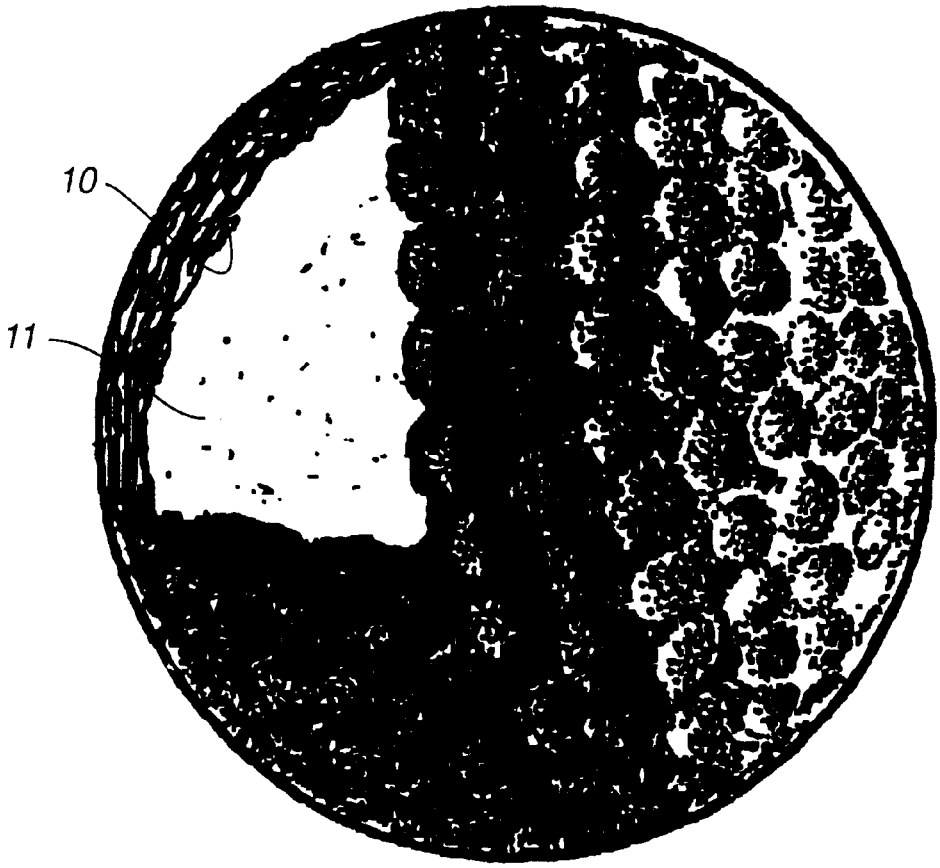
FIG. 1 is a partial cut-away view of a container according to the invention for delivery to a fire.

The fire extinguishing or fire retardant agents typically used in the present invention are materials which can be totally absorbed and/or dispersed into the target environment, yet which are benign relative to the target environment. The preferred materials for the solid shell of the container are solid carbon dioxide, ice or other solid fire retardant or extinguishing agents. Carbon dioxide and ice are the preferred materials for use as the shell as a non-lethal weapon. As explained in more detail below, the container may be sealed under pressure or it may be unpressurized. The shell material is selected so that the shell material itself also serves as a fire extinguishing or retarding agent, thereby enhancing the effects of the material dispersed from the container. The shell composition and thickness are designed so that it will weaken or fail, releasing the enclosed material, either by the phase change of the shell material, i.e. melting or sublimation, and/or by bursting of the shell upon impact.

The shell thickness of the container may be readily determined by those of ordinary skill in the art based on the type of material to be dispersed, the desired radius of dispersement, the time-delay, if any, between the placement of the container and the moment of dispersement, and the target environment conditions for dispersement of the encased material. A property of the container wall is that in the target environment it will undergo a change in phase consistent with that which would readily disperse or be absorbed by the target environment. Typically, the shell will change its physical state in accordance with the system state variables at the target or environment. That is, the shell material will melt and/or sublime at the temperature or other environmental conditions at the target site.

The materials may be distributed at the target site by bursting of the container. For example, a shell of solid carbon dioxide may contain a core of a liquid dioxide, water, or other extinguishing agent or fire retarding agent. The shell may also, for example, be made of ice and contain a core of liquid carbon dioxide, water or other extinguishing agent or retarding agent. Furthermore, the shell may be made of a solid retardant and/or extinguishing agent and the core may contain liquid carbon dioxide, water, or other extinguishing agent and/or retarding agent. The contents may be pressurized or not, depending on the timing of the burst, desired radius of dissipation or desired dispersion method. Typically, the core material will be sublimable at a temperature above about −150° C. up to about 100° C. The bursting of the container due to changes in environmental conditions or impact at the target site is much more desirable than the use of explosives. Explosive bursting charges are environmentally unacceptable, can add undesirable debris to the environment and generate incendiary materials as a result of the explosion process.

Another method of release of the materials is by diffuision mixing. The material within the container, i.e. bacterial agents or chemical agents may be diffuision driven for dispersion and thus may require a release mechanism involving the erosion of the container wall.

Finally, release may be triggered by an environmental effect, such as thermal or pressure activation such that the thermodynamic and mechanical properties of the shell and the contents serve as rupture triggers within the container.

The containers may be delivered from aircraft or thrown or shot into the target area using catapults, air pressure guns and the like.

Referring to FIG. 1, there is shown a partial cutaway of one embodiment of a container according to the present invention. The container comprises a shell (10) and a hollow interior containing a slurry, liquid or gas of a fire extinguishing or fire retarding material (11). The shell (10) is also made of a fire extinguishing or retarding material. Indentations (10*a*) serve to facilitate release of the container from the mold from which it is made. Preferably, the container is of a relatively large size, having an interior volume determined by the fire suppression application. It can carry charges of sufficient amounts of material such as carbon dioxide, which will at room temperature be converted into a large volume of gaseous carbon dioxide and some liquid carbon dioxide. The vapor pressure of liquid carbon dioxide rises with temperature, and can reach approximately 1,000 atmospheres at temperatures of about 160° C. Thus, the containers in the practice of the invention when using carbon dioxide as an interior component should be constructed to resist rupture when introduced into a fire until the maximum internal stress in the shell wall is exceeded by either or both the internal pressure built up or external forces. In practice, the charged container is introduced into the fire by being dropped, thrown or shot into the blaze. The heat of the fire primarily reduces the shell thickness, and thus its overall strength to a point where the internal pressures cause shell rupture and disburse the contained material. This is assuming that the shell was not designed to rupture on impact. The heat of the fire raises the temperature slightly within this container design. The container explodes spreading the contents into the surrounding area. The liquid and gaseous contents expand rapidly with the liquid material phase changing to gaseous, thus chilling the surrounding area as well as displacing hot gases and replacing them with $CO_2$. The contents of the container, as well as the shattered container particles are rapidly vaporized to provide a blanket in the target area which serves to smother and extinguish the blaze.

The process of the invention may be employed with containers of varying size, from those which are very small, which may be manually thrown or dropped into the fire to those which must be either mechanically catapulted to the fire or dropped from an aircraft or balloon suspended above the fire.

Figure 2:
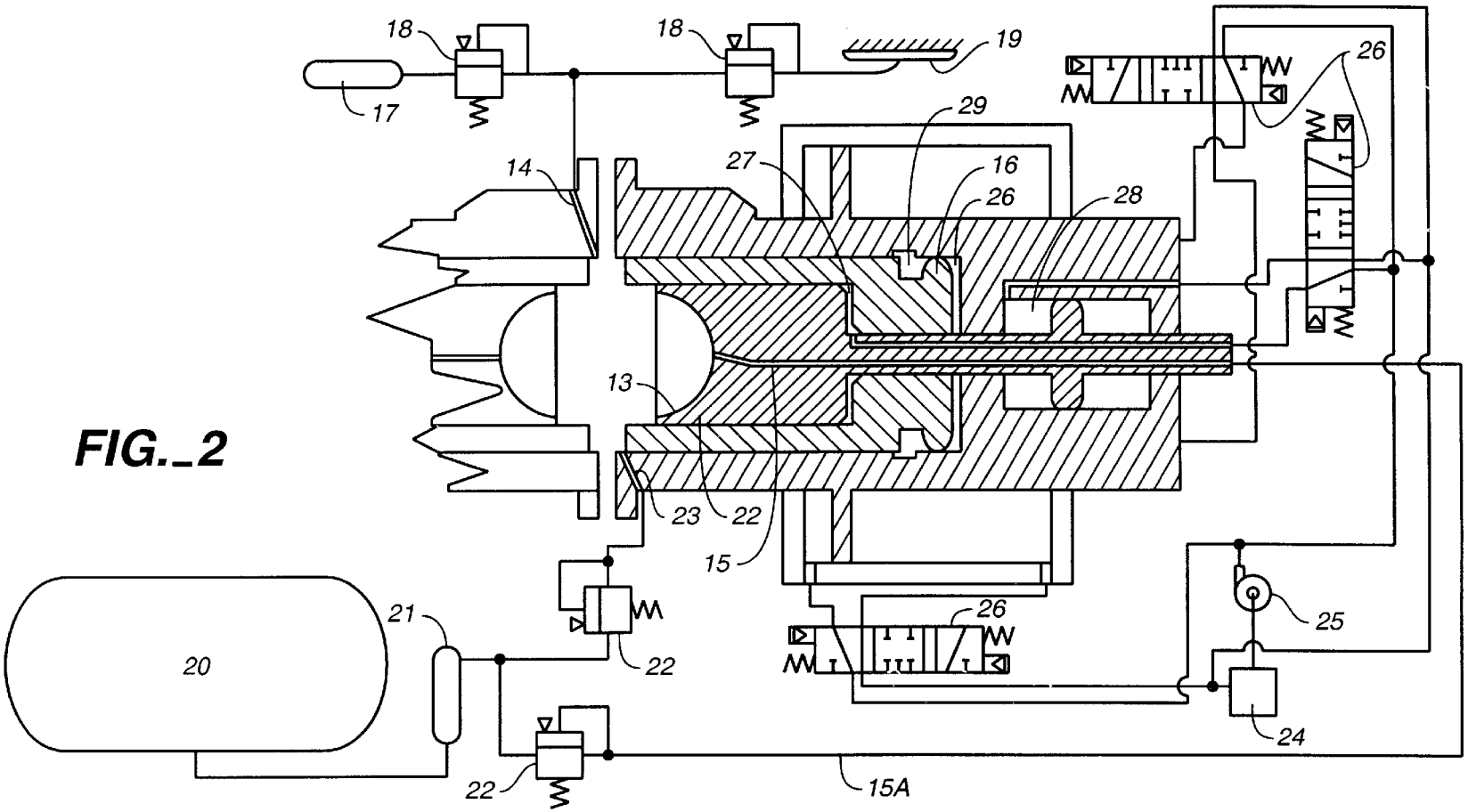
FIG. 2 is a cross-section of an apparatus for preparing the container shown in FIG. 1.

Referring to FIG. 2, there is shown an apparatus for forming a container according to FIG. 1 by controlled temperature time phase transition. For convenience, only half of the apparatus is shown with the mirror image of the other half (not shown) required to make a complete container. There is a piston (12) having a surface (13) in the shape of desired shape of the container with ridges (not shown) that form indentations such as (10*a*) in the exterior surface of the shell which serve to promote release of the shell from the mold. This piston can be cooled with a cooling agent such as liquid nitrogen, which is introduced through conduit (14). The piston (12) is compressed to form the shell from fluid (liquid, slurry or gaseous) initially introduced through line 15. The shell is then filled through conduit (15) with the liquid, slurry or gas materials intended to comprise the core. The sealing piston (16) is utilized to seal the contents within the shell. The forming and sealing pistons (12) and (16) are then withdrawn, respectively, from each half of the formed container and the container is released from the surface (13). Alternatively, a solid shell can be formed using a similar apparatus having walls sufficient to withstand the necessary pressure for a controlled pressure-time phase transition.

As shown, the liquid nitrogen coolant is supplied from pressurized tank 17 where it is collected in depressurized traps 18. Excess nitrogen gas is vented through vent 19.

Carbon dioxide is supplied from tank 20 from which it is filtered through filter 21 and depressurized in traps 22. The carbon dioxide which will be frozen to form the shell of the canister is introduced via conduit 23 to surface 13. The carbon dioxide which will form the liquid/gas/solid contents of the container is introduced via line to conduit 15.

The hydraulic system for manipulating pistons 12 and 16 is provided by hydraulic fluid storage tank 24 and pump 25. The flow of hydraulic fluid is controlled by valve controllers 26 to compress pistons 16 or 12, respectively, by pressuring compartments 26 or 27. The pistons 16 or 12 are withdrawn, respectively, by pressuring compartments 29 or 28.

Materials other than carbon dioxide may be utilized in tank 20, such as water or aqueous slurries or solutions of fire retardant agents.

It is understood that certain changes and modifications may be made to the above containers and apparatus without departing from the scope of the invention and it is intended that all matter contained in the above description shall be interpreted as illustrative and not limiting the invention in any way.

What is claimed is:

1. An apparatus for forming a projectile comprising: a shaped molding cavity for receiving a fluid to form a shell in the shape of said cavity; a first conduit for directing a cooling agent for cooling said cavity to solidify said fluid thereby forming said shell; a second conduit for filling said shell with liquid, slurry or gaseous contents; and a first compression piston for compressing said shell to seal said liquid, slurry or gas within said shell to form said projectile.

2. An apparatus according to claim 1 wherein said cavity is in a second piston which is cooled to form said shell.

3. An apparatus according to claim 2 wherein said second piston is sufficient to withstand pressure necessary to form said shell.

4. An apparatus according to any of claims 1 through 3 wherein said cavity is defined by a surface comprising ridges to form indentations on said shell.

5. A method of extinguishing or retarding fire, said method comprising:

confining a fluid fire extinguishing or fire retarding agent in liquid, slurry or gaseous form within a container, said container comprising a shell comprising a solid fire extinguishing or fire retarding agent, wherein said solid agent comprises solid carbon dioxide; and delivering said container in close proximity to burning substances in said fire, whereby said container ruptures to release said solid and fluid agents in liquid, solid or gaseous form onto said burning substances.

6. The method according to claim 5, wherein said solid and fluid agents comprise carbon dioxide.

7. A method of forming a projectile, said method comprising:

forming a shell of predetermined shape and size, said shell comprising a solid fire extinguishing or fire retarding agent, wherein said solid agent comprises solid carbon dioxide;

filling said shell with a core comprising a fluid fire extinguishing or fire retarding agent in liquid, slurry or gaseous form; and sealing said shell.

8. The method according to claim 7, wherein said solid and fluid solid agents comprise carbon dioxide.

9. A crowd dispersal method, comprising:

confining a fluid non-lethal solid agent in liquid, slurry or gaseous form within a container, said container comprising a shell comprising a non-lethal agent in solid form, wherein said solid agent comprises solid carbon dioxide; and delivering said container in close proximity to persons in a crowd, whereby said container ruptures to release said solid and fluid agents.

10. The method according to claim 9, wherein said solid and fluid agents comprise carbon dioxide.

11. A method of forming a projectile, said method comprising:

forming a shell of predetermined shape and size, said shell comprising a solid non-lethal agent wherein said solid agent comprises carbon dioxide;

filling said shell with a core comprising a non-lethal fluid agent in liquid, slurry or gaseous form; and sealing said shell.

12. The method according to claim 11, wherein said solid and fluid agents comprise carbon dioxide.

13. A container for delivering a fluid material into a target environment, said container comprising:

a shell comprising solid carbon dioxide; and a fluid material in liquid, slurry or gaseous form confined within said shell.

14. The container of claim 13 wherein said fluid material comprises carbon dioxide.

15. The container of claim 13 wherein said fluid material comprises water.

16. The container of claim 13, wherein said fluid material is confined under pressure within said shell.

17. A container for delivering a fluid material into a target environment, said container comprising:

a shell comprising ice; and a fluid material in liquid, slurry or gaseous form confined within said shell, wherein said fluid material comprises carbon dioxide.

18. The container of claim 17, wherein said fluid material is confined under pressure within said shell.

19. A method of delivering a fluid material into a target environment, said method comprising:

confining a fluid material in liquid, slurry or gaseous form within a container, said container comprising a shell, wherein said shell comprises solid carbon dioxide; and delivering said container into a target environment, whereby said container ruptures to release said fluid material in liquid, slurry or gaseous form into said target environment.

20. The container of claim 19, wherein said fluid material comprises carbon dioxide or water.

21. The container of claim 19, wherein said fluid material is confined under pressure within said shell.

22. A method of forming a projectile, said method comprising:

forming a shell of predetermined shape and size, wherein said shell comprises solid carbon dioxide;

filling said shell with a fluid material in liquid, slurry or gaseous form; and sealing said shell.

23. The container of claim 22, wherein said fluid material comprises carbon dioxide or water.

24. The container of claim 22, wherein said fluid material is confined under pressure within said shell.

* * * * *